United States Patent [19]

Wridge, Jr. et al.

[11] Patent Number: 4,995,124

[45] Date of Patent: Feb. 26, 1991

[54] CONSTANT PRESSURE LOAD BEARING AIR CHAMBER

[75] Inventors: Wilbur S. Wridge, Jr., Portland, Oreg.; Lloyd D. Everard, Kent, Wash.

[73] Assignee: Sustena, Inc., Kent, Wash.

[21] Appl. No.: 261,027

[22] Filed: Oct. 20, 1988

[51] Int. Cl.[5] ..... A47C 27/08

[52] U.S. Cl. ..... 5/450; 5/453

[58] Field of Search ..... 5/449, 453, 450, 455; 297/DIG. 3

[56] References Cited

U.S. PATENT DOCUMENTS

| | | | |
|---|---|---|---|
| 1,218,291 | 3/1917 | Meinecke | 5/455 X |
| 1,271,472 | 7/1918 | Jakobson | 5/450 |
| 1,332,933 | 3/1920 | Sylvester | 5/450 |
| 2,751,610 | 6/1956 | Griswold | 5/453 |
| 3,042,941 | 7/1962 | Marcus | 5/450 |
| 3,303,518 | 2/1967 | Ingram | 5/349 |
| 3,864,766 | 2/1975 | Prete | 5/450 |
| 3,872,525 | 3/1975 | Lea et al. | 5/348 |
| 3,877,092 | 4/1975 | Gaiser | 5/343 |
| 3,959,835 | 6/1976 | Nos | 5/455 |
| 4,078,842 | 3/1978 | Zur . | |
| 4,224,706 | 9/1980 | Young et al. | 5/449 |
| 4,306,322 | 12/1981 | Young et al. | 5/449 |
| 4,394,784 | 7/1983 | Swenson et al. | 5/453 |
| 4,428,087 | 1/1984 | Horn | 5/455 |
| 4,525,886 | 7/1985 | Savenije | 5/464 |
| 4,634,179 | 1/1987 | Hashimoto et al. | 297/DIG. 3 |
| 4,638,519 | 1/1987 | Hess | 5/455 |
| 4,655,505 | 4/1987 | Kashiwamura | 297/DIG. 3 |
| 4,662,012 | 5/1987 | Torbet | 5/455 |
| 4,679,264 | 7/1987 | Mollura | 5/453 |
| 4,686,722 | 8/1987 | Swart | 5/453 |
| 4,694,515 | 9/1987 | Rogers | 5/449 |
| 4,694,520 | 9/1987 | Paul et al. | 5/449 X |
| 4,711,275 | 12/1987 | Ford et al. | 5/455 X |
| 4,745,647 | 5/1988 | Goodwin | 5/455 X |
| 4,797,962 | 1/1989 | Goode | 5/455 X |
| 4,873,737 | 10/1989 | Savenije | 5/453 |

FOREIGN PATENT DOCUMENTS

| | | |
|---|---|---|
| 7906927A | 3/1981 | Netherlands . |

*Primary Examiner*—Gary L. Smith
*Assistant Examiner*—Michael J. Milano
*Attorney, Agent, or Firm*—Christensen, O'Connor, Johnson & Kindness

[57] ABSTRACT

The air chamber includes a control for manually selecting a desired pressure within the chamber. Means for sensing the air pressure within the chamber are provided as are pump means for adding air to the chamber and vent means for removing air from the chamber. Control circuitry adds or removes air from the chamber responsive to the sensed pressure to maintain the pressure within the chamber at the preset level. Structural means are provided within the chamber for supporting a portion of a load placed thereon and thus decreases air pressure within the chamber to avoid deflation.

25 Claims, 2 Drawing Sheets

CONSTANT PRESSURE LOAD BEARING AIR CHAMBER

BACKGROUND OF THE INVENTION

1. Field of the Invention

The present invention relates broadly to air chambers adapted to support an external load and an apparatus for maintaining the air pressure within the chamber at a relatively constant preset level when the load is applied thereto. In particular, the invention relates to a constant pressure chamber suitable for use as an air mattress, seat cushion or other load bearing device.

2. Description of Prior Art

A long-standing problem in air mattress design involves the ability to maintain constant pressure within the air mattress in spite of varying loads on the mattress as one or more users sit or lie on the bed, toss and turn during sleep or arise and return to bed. The "feel" of the mattress to the user is directly related to the amount of air pressure within the mattress. Thus, in an air mattress into which air is drawn to a certain pressure and then sealed, such as those shown in U.S. Pat. Nos. 3,872,525 and 3,877,092, the internal pressure increases when a user lies thereon and the mattress thus "feels" harder as the load thereon increases.

U.S. Pat. Nos. 4,224,706 and 4,306,322 disclose air mattress systems which allow the firmness of the mattress to be controlled when a person is lying thereon through the use of a separate bladder which contains a quantity of air adapted to be transferred between the air mattress and the bladder responsive to changes in the volume of the bladder.

Also known are manually operated systems, such as that shown in U.S. Pat. No. 4,394,784, where air is supplied to a mattress by a blower or vented from the mattress through valves, both the blower and the valves being electronically controlled by hand-held control units. U.S. Pat. No. 4,078,842 discloses an inflatable auto seat wherein pressurized air is supplied by a manually operated compressor. U.S. Pat. No. 3,303,518 discloses an inflatable mattress wherein air is supplied to compartments therein by hoses connected to a remotely located compressor/pump controlled by the user.

U.S. Pat. No. 4,686,722 discloses a mattress formed from a plurality of individual cushions interconnected by ducting to an air pressure source. The pressure in selected cushions may be controlled by computer.

U.S. Pat. No. 4,694,520 discloses an air mattress which includes a sensor 170 positioned within the mattress which turns on an air compressor when the mattress deflates to a point where a patient comes in contact therewith.

U.S. Pat. No. 4,711,275 discloses a mattress including a rather complex system having a plurality of air compressors and pressure sensors to inflate and deflate portions of the mattress in cycle to prevent bedsores on a bedridden patient.

U.S. Pat. No. 4,679,264 discloses a self-regulating air mattress including a reservoir and means for adding or removing air from the system. A sensing device is disclosed which is adapted to sense the pressure in the mattress and add or remove air therefrom to maintain a constant pressure. Experimentation has shown, however, that such a system, supposedly designed to maintain pressure within a mattress at a predetermined level by sensing pressure and adding or removing air from the mattress in response to a change in pressure, simply do not work. The problem of such systems is that, assuming a preset pressure to be sensed and maintained, the pressure within the mattress is increased when a load is placed thereon. This increased pressure is sensed and air is vented from the mattress in response thereto. However, venting of air from the mattress does not decrease pressure within the mattress so long as the load remains thereon until the mattress is almost totally deflated.

The present invention provides an air mattress or the like which can be maintained at a constant pressure even under load without deflating.

SUMMARY OF THE INVENTION

It is known that pressure is generated in the air chambers of an air mattress by the force of the semielastic walls of the chambers upon the air captured therewithin. When a load, such as a person, is placed upon the mattress, the pressure within the mattress is produced both by the downward force exerted by the weight of the person and the forces generated by the semielastic mattress chamber walls. It has been found that if the size of the load placed on the mattress is relatively small, the increase in pressure normally caused by the load can be compensated for by the elasticity of the air chamber walls. As the load increases, however, the ability of the chamber walls to absorb the increasing pressure load diminishes and the air pressure within the chamber increases. As a result, the firmness of the mattress is also increased. In known active sensing mattress systems, the pressure sensor would, at this time, begin venting air from the mattress chambers to the atmosphere in an attempt to lower the pressure within the chambers. However, since the weight upon the mattress remains constant, and thus the pressure within the chambers remains at a constant high level, the venting of air to atmosphere does not reduce pressure but rather merely deflates the mattress.

In the present invention, applicants have solved this problem by providing a structure within the mattress chamber itself which is adapted to support a portion of a load placed upon the mattress to thereby reduce the air pressure within the mattress to a desired preset pressure level such that the sensor stops venting air to the atmosphere and the mattress does not deflate. In a preferred form, a resilient open-cell foam cushion is placed within the mattress which, while typically not resilient enough to constitute a comfortable mattress by itself, has the ability to support a sufficient amount of the weight of a person to allow the pressure within the mattress to be reduced. The reduced pressure is sensed and venting of air to the atmosphere is stopped. In practice, it has been found that due to the lightweight nature of the foam cushion, the "feel" of the air mattress does not change even when a person's body bears upon the foam through the upper surface of the mattress.

BRIEF DESCRIPTION OF THE DRAWINGS

The invention will be described more fully with reference to the preferred embodiment shown in the drawings wherein.

DETAILED DESCRIPTION OF THE INVENTION

Figure 1:
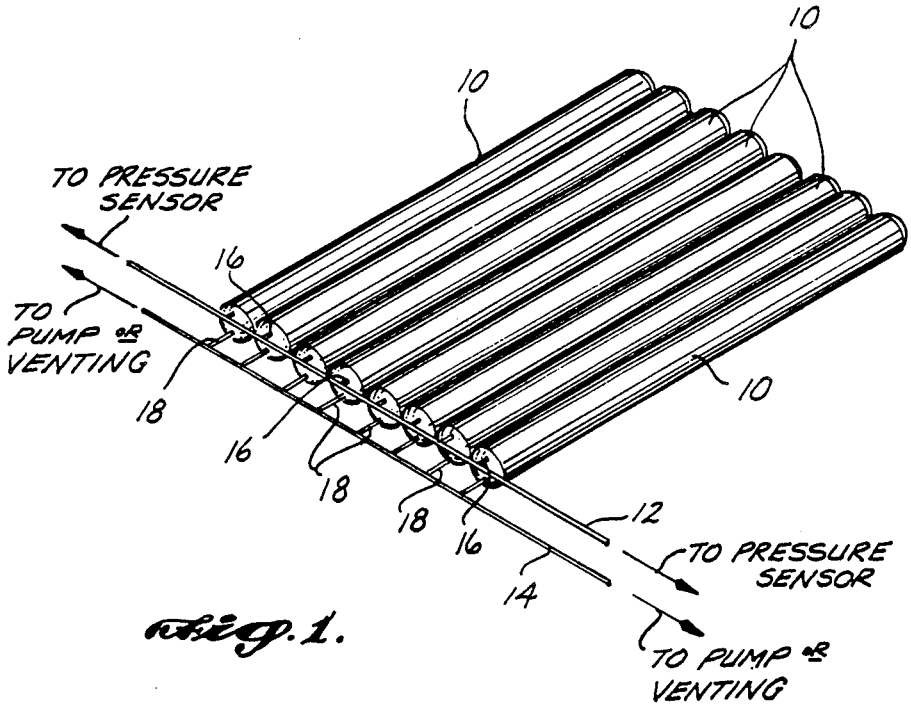
FIG. 1 is a schematic perspective view of a plurality of tubes suitable for use as the air support chambers of an air mattress, including conduit means interconnecting the tubes, connecting them to both a pressure sensor and pumping or venting means.
Figure 1:
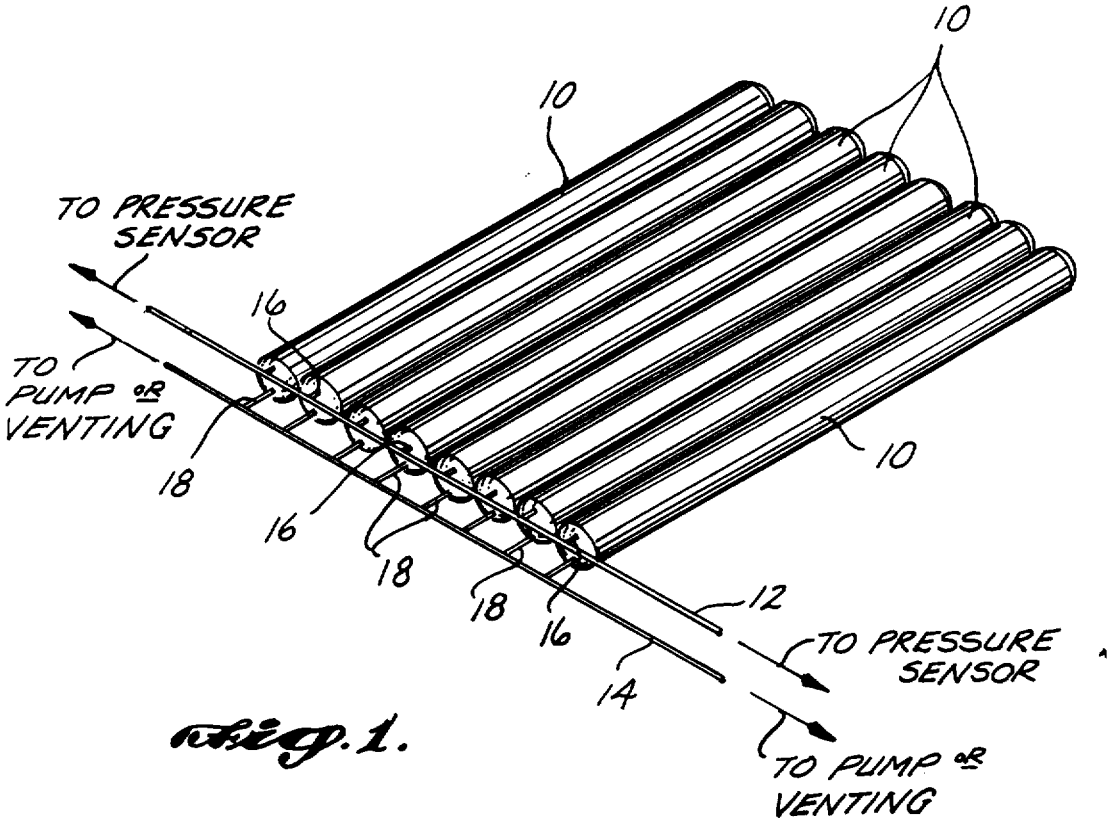

Referring initially to FIG. 1, a plurality of air chambers 10 are disclosed positioned side by side in the general form of a tube-shaped mattress core. In a preferred embodiment, the chambers are defined by membranes 11 formed of polyvinyl chloride in a known manner although polyurethane or other suitable materials may also be used. In use as a mattress, the membranes 11 are typically covered on at least their top and bottom by a light foam pad 22 and the entire unit encased within a fabric cover 24 for sleeping comfort.

It has been found that in a preferred embodiment, the membrane 11 may be sized so that four membranes placed side by side define a single bed of so-called "twin bed" size, while eight membranes provide a satisfactory double bed.

As illustrated in FIG. 1, manifold means 12 interconnect all of the chambers 10 so that a uniform pressure is maintained in all of the chambers which, as indicated, may be sensed by a pressure sensor to which manifold 12 is connected. Likewise, manifold 14 interconnects all of the tubes and is in turn connected to air pump or air vent means in a manner which will be described in greater detail hereafter. Tubes 16 and 18 are shown connecting the individual chambers to the manifolds 12 and 14 respectively, but it will be understood that the particular shape of the tubes, manifolds, and the connections therebetween may be varied, and FIG. 1 is meant to be illustrative only.

In particular, it has been found that a double bed mattress is preferably provided with dual sensing, pumping and venting means so that persons lying side by side are able to separately control the air pressure within the chambers on their side of the mattress and the consequent firmness or "feel" of the mattress.

Figure 2:
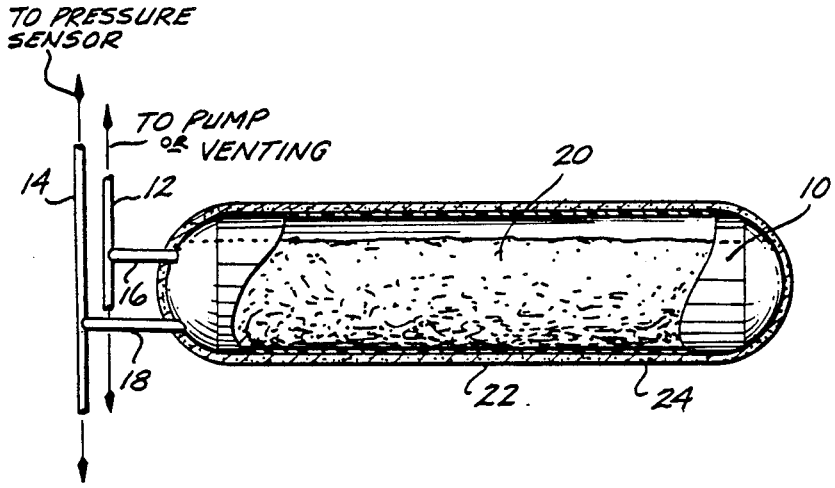
FIGS. 2a–2c are schematic side elevational views of the embodiments of the air chambers of FIG. 1 with portions of the sides broken away to show the positioning of the support elements therein.
Figure 2A:
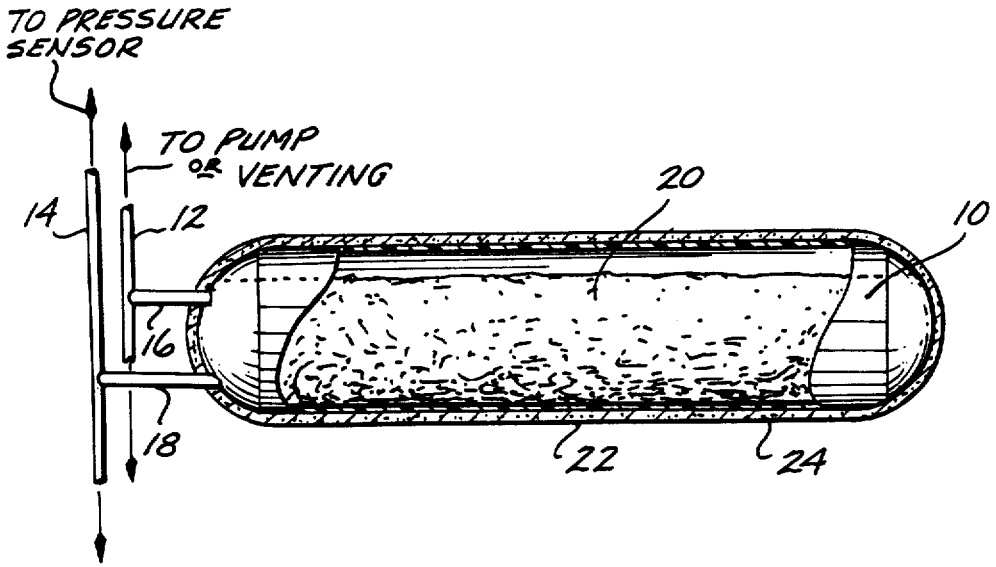

Referring additionally to FIG. 2a, a support element 20 is shown positioned within the chamber 10 to act as load support in a manner to be described in greater detail hereafter. Element 20 is preferably formed of a lightweight, open cell foam and it will be understood that element 20 is positioned within chamber 10 during construction of the chamber and that the foam element may be of any suitable shape and may be affixed to or allowed to move loosely within chamber 10. The foam material 20 need not have a great crushing strength since the foam itself does not act as the major weight supporting element of the air mattress and, thus, in and of itself, need not be of a strength sufficient to be used as a satisfactory mattress. As depicted, the support element 20 is dimensioned so that the top of the support element is spaced away from the top portion of the inflatable membrane 11 when the membrane is fully inflated.

Figure 2B:
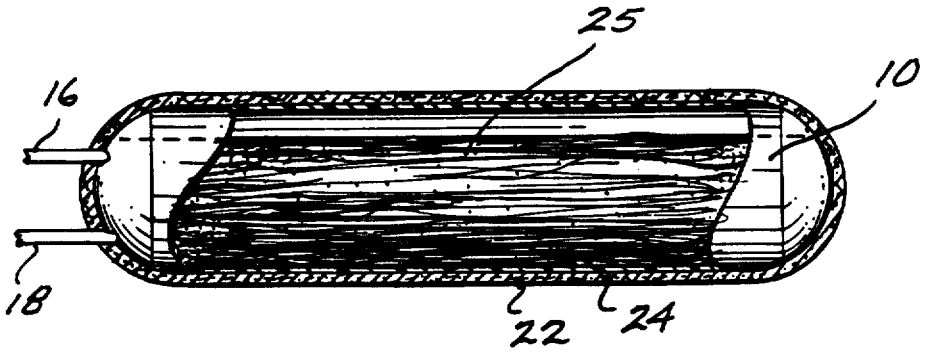
Figure 2C:
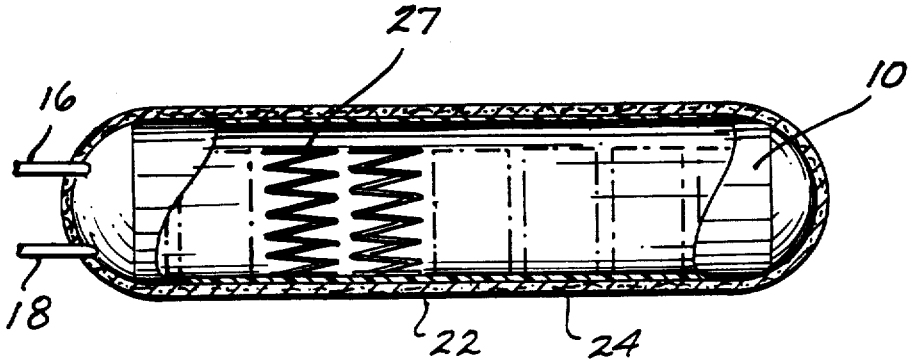

Besides the described foam material, a lightweight fibrous material or any other resilient material including a metal spring may be satisfactorily used to accomplish the function of supporting a portion of the user's weight to prevent total deflation of the mattress in the manner described hereafter. FIG. 2b depicts a version of the chamber 10′ wherein lightweight fibrous material 25 is provided as the fill material and FIG. 2c depicts a version of still another alternative embodiment of the invention wherein the metal springs 27 are disposed within the chamber 10″ to serve as the support element.

While softness and resiliency are desired for comfort in a mattress, it will be understood that a nonresilient weight support means might be satisfactorily used to again accomplish the goal of decreasing air pressure to the extent necessary to cause the sensor to stop venting air to the atmosphere when a load is placed upon the inflated chamber.

FIG. 2a also discloses the chamber covering foam pad 22 described above, as well as conventional fabric cover 24 surrounding and overlying the air chambers.

Figure 3:
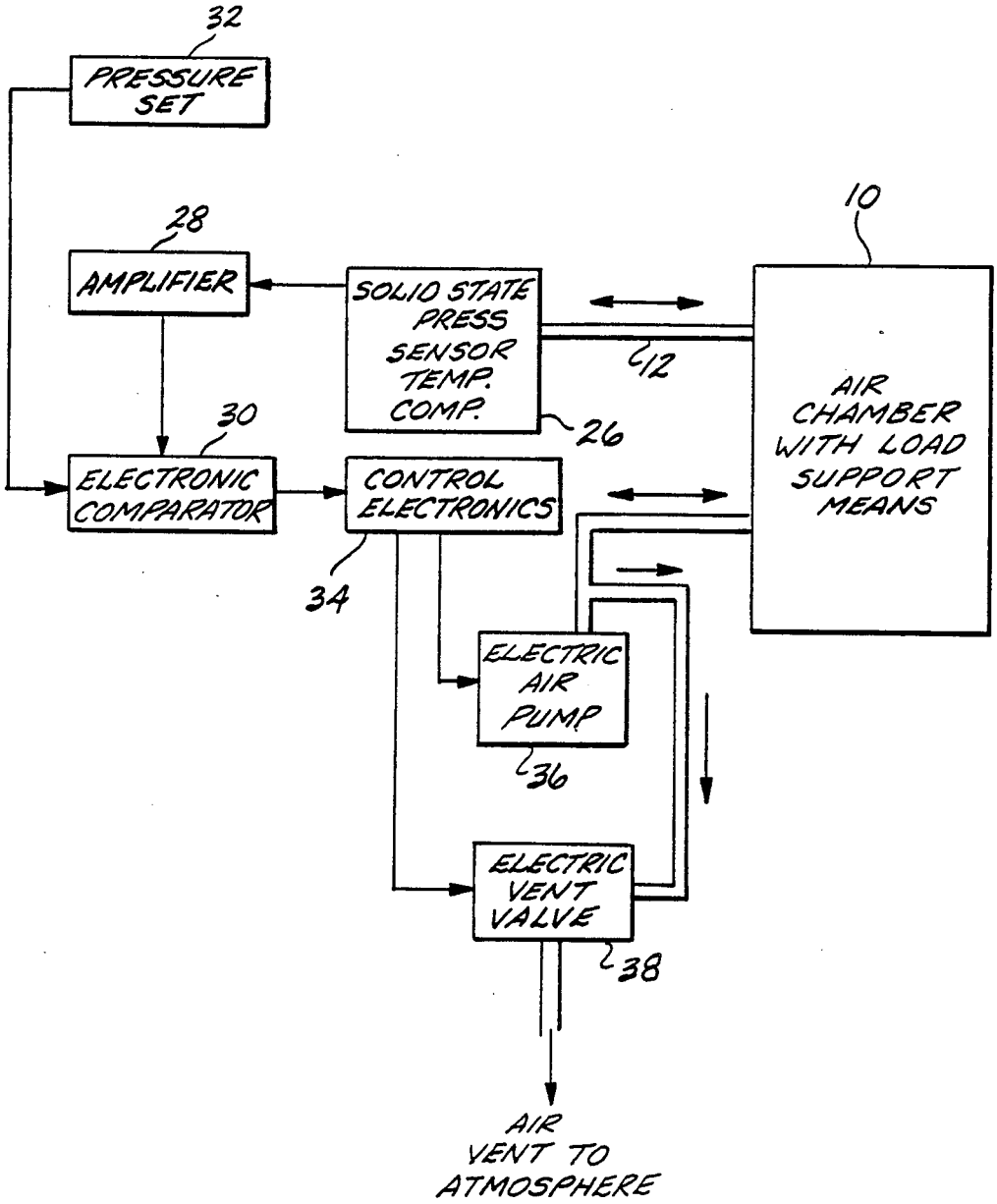
FIG. 3 is a block diagram illustrating the movement of air into and out of a chamber of the present invention, including the electronic controls therefor.

Referring now to the block diagram shown in FIG. 3, the operation of the present invention will be described in detail. As illustrated, chamber 10 is shown to be connected by means of conduit 12 to pressure sensor 26. In a preferred form, the pressure sensor is a conventional solid state device which is electronically compensated for change in ambient air. It has been found that satisfactory pressures within chamber 10 range from between two inches to ten inches of gage water pressure, which is approximately one-thirtieth of atmospheric pressure. These small pressures place little stress upon the seams of the chamber 10, and thus the unit made according to the present invention has been found to be long-lived.

The output signal of pressure sensor 26 is led through a conventional amplifier means 28 to an electronic comparator 30 wherein the signal from the amplifier is compared to a signal generated by pressure select control 32. Elements 30 and 32 are conventional, off-the-shelf items, element 32 typically being of a type which allows a user to select the degree of mattress firmness, i.e., pressure within the air chamber, by simply turning a dial to an indicated setting. Air pressure within the chamber may be changed by simply turning the dial to a different setting. Electronic comparator 30 compares the selected pressure with the actual pressure within chamber 10 as transmitted through amplifier 28. Comparator 30 produces an output signal that is forwarded to control electronics 34 that controls an air pump 36 and a selectively open vent valve 38. The control electronics 34, in response to the comparator signal, either turns on electric air pump 36 or opens electric vent valve 38 to add or remove air from chamber 10. In a preferred embodiment, pump 36 is a diaphragm pump. Control electronics 34 are conventional as are air pump 36 and vent valve 38.

In typical operation, a user selects a desired air pressure within chamber 10 by adjusting the dial on the pressure select control 32. Assuming an initially deflated chamber, electric air pump 36 is activated to pump air into chamber 10 until pressure sensor 26 senses the pressure within the chamber is substantially equal to the desired selected pressure. If the air pressure within chamber 10 should increase or decrease due, for example, to a change in temperature or atmospheric pressure of the ambient air within the room where the mattress is placed, the change in pressure will be sensed and either air pump 36 turned on to force air into chamber 10 or vent valve 38 opened to bleed air from the chamber. In this manner the preselected pressure is maintained.

When a person lies upon the mattress, the pressure within chamber 10 is increased substantially. This increase in pressure is sensed by sensor 26, thus causing vent valve 38 to be opened to vent air from the chamber 10 in an attempt to decrease the pressure within the chamber. So long as the person remains on the mattress, however, simply bleeding air from the mattress will not decrease pressure within the chamber. In prior art mattresses, venting would be continued until such time as the mattress was near totally deflated and the user found himself in contact with the mattress support or floor. In the present invention, however, as air is vented to the atmosphere, the person comes in contact with the resilient means 20 within the air chamber 10 such that a portion of the user's weight begins to be supported thereby. Supporting of the user's weight, by the resilient foam, for example, causes a decrease in the air pressure within chamber 10 which decrease is sensed by pressure sensor 26. When the decreased pressure equals the pressure previously selected by the user at pressure set 32, vent valve 38 is closed and the pressure within the mattress is stabilized without total deflation occurring. In practice, it has been found that the selection of a soft resilient foam for placement within chamber 10 allows a portion of the user's weight to be borne by the foam without the user experiencing any substantial change in the "feel" of the mattress.

While the present embodiment has been disclosed as embodying elongate, generally parallel, interconnected tubes, it will be understood that tubes of a variety of shapes and configurations may be employed in connection with individual pressure sensing and control means to create a mattress wherein portions of the surface may be separately controlled as to firmness. Such a mattress is particularly valuable for use in connection with patients suffering from burns, skin ulcers or other conditions wherein it is helpful to support a portion of the patient's body on a mattress of reduced firmness.

While the preferred embodiments of the invention have been illustrated and described, it will be understood that variations will occur to those skilled in the art. Accordingly, the invention is not to be limited to the specific embodiments illustrated and described, and the true scope and spirit of the invention are to be determined by reference to the following claims.

We claim:

1. An air mattress capable of supporting a load comprising:

(a) an inflatable membrane defining a chamber having a chamber air pressure;

(b) load supporting material disposed in said chamber;

(c) a selectively actuatable air pump in fluid communication with said chamber to supply pressurized air thereto;

(d) a selectively openable vent valve in fluid communication with said chamber;

(e) a pressure sensor in fluid communication with said chamber for generating a sensed pressure signal representative of said chamber air pressure;

(f) a pressure selector generating a desired pressure signal representative of a desired chamber air pressure; and (g) a control means connected to said air pump and said vent valve and receiving said sensed pressure signal and said desired pressure signal for maintaining said chamber at approximately said desired chamber air pressure whereby when the load on said membrane causes said chamber air pressure to rise above said desired air pressure, said vent valve is opened until at least a portion of the load is supported by said load supporting material so that said chamber air pressure falls to approximately said desired chamber air pressure.

2. The air mattress of claim 1 wherein said control means includes a comparator for receiving said sensed pressure signal and said desired pressure signal in response thereto generating a comparator signal and a control circuit for receiving said comparator signal and in response thereto, controlling said air pump actuation and said vent valve opening.

3. The air mattress of claim 1 wherein said control means, in response to said chamber air pressure being below said desired chamber air pressure, actuates said air pump.

4. The air mattress of claim 1 wherein said desired chamber air pressure is between two and ten inches of water.

5. The air mattress of claim 1 wherein said load supporting material comprises a foam cushion.

6. The air mattress of claim 5 wherein said foam load supporting material is of insufficient resiliency to provide sole support for a load normally supported by said mattress.

7. The air mattress of claim 5 wherein said foam is dimensioned so that said foam is spaced away from the top portion of said membrane when said membrane is fully inflated.

8. The air mattress of claim 1 wherein said load supporting material is of insufficient resiliency to provide the sole support for a load normally supported by said mattress.

9. The air mattress of claim 8 wherein said control means includes a comparator for receiving said sensed pressure signal and said desired pressure signal in response thereto generating a comparator signal and a control circuit for receiving said comparator signal and in response thereto, controlling said air pump actuation and said vent valve opening.

10. The air mattress of claim 1 wherein said load supporting material is dimensioned so that said material is spaced away from the top portion of said membrane when said membrane is fully inflated.

11. The air mattress of claim 10 wherein said control means includes a comparator for receiving said sensed pressure signal and said desired pressure signal in response thereto generating a comparator signal and a control circuit for receiving said comparator signal and in response thereto, controlling said air pump actuation and said vent valve opening.

12. The air mattress of claim 1 further including at least two said membranes each having a chamber, each of said chambers including load supporting material disposed therein, a pressure sensor connected thereto to measure said chamber air pressure, and said air pump and said vent valve connected thereto, and said control means maintaining said chambers at approximately said desired chamber air pressure.

13. The load-supporting assembly of claim 1 wherein said desired chamber air pressure is between two and ten inches of water.

14. A method of supporting a load on an inflatable air chamber including the steps of:

(a) inflating an air chamber defined by an inflatable membrane to a desired chamber air pressure, said air chamber having associated therewith a pressure sensor to monitor said chamber air pressure, a control means responsive to said pressure sensor for maintaining said chamber air pressure by selectively supplying air to and venting air from said air chamber, and a load-supporting means inside said air chamber;

(b) placing the load on said membrane so as to increase said chamber air pressure above said desired chamber air pressure so that said control means vents air from said air chamber;

(c) venting air from said air chamber so that at least a portion of the load is supported by said load support means so that chamber air pressure falls to approximately said desired chamber air pressure; and (d) sensing decrease in said chamber air pressure to approximately said desired chamber air pressure by said pressure sensor and, in response to said sensed decrease, said control means ceasing venting air from said chamber so that said chamber air pressure is maintained at approximately said desired chamber air pressure.

15. The method of claim 14 further including the steps of said control means adding air into said air chamber to increase said chamber air pressure whenever chamber air pressure sensed by said pressure sensor is below said desired chamber air pressure.

16. The method of claim 14 further including said control means obtaining said desired chamber pressure from a pressure select means electronically connected thereto.

17. A pressurized, load-supporting assembly comprising:

(a) an inflatable membrane defining a chamber having a chamber air pressure;

(b) load supporting material disposed in said chamber;

(c) a selectively actuatable air pump in fluid communication with said chamber to supply pressurized air thereto;

(d) a selectively openable vent valve in fluid communication with said chamber;

(e) a pressure sensor in fluid communication with said chamber for generating a sensed pressure signal representative of said chamber air pressure;

(f) a pressure selector generating a desired pressure signal representative of a desired chamber air pressure; and (g) a control means connected to said air pump and said vent valve and receiving said sensed pressure signal and said desired pressure signal for maintaining said chamber at approximately said desired chamber air pressure whereby when a load on said membrane causes said chamber air pressure to rise above said desired air pressure, said vent valve is opened until at least a portion of the load is supported by said load supporting material so that said chamber air pressure falls to approximately said desired air pressure.

18. The load-supporting assembly of claim 17 wherein said load-supporting material is a plastic foam.

19. The load-supporting assembly of claim 17 wherein said load-supporting material is an open-cell plastic foam.

20. The load-supporting assembly of claim 17 wherein said load-supporting material comprises a resilient fibrous material.

21. The load-supporting assembly of claim 17 wherein said load-supporting material comprises at least one metal spring means.

22. The load-supporting assembly of claim 17 wherein said load-supporting material is of insufficient resiliency to provide the sole support for a load normally supported by said assembly.

23. The load-supporting assembly of claim 17 wherein said load-supporting material is dimensioned so that said material is spaced away from the top of said membrane when said membrane is fully inflated.

24. The load-supporting assembly of claim 17 wherein said control means includes a comparator for receiving said sensed pressure signal and said desired pressure signal in response thereto generating a comparator signal and a control circuit for receiving said comparator signal and in response thereto, controlling said air pump actuation and said vent valve opening.

25. The load-supporting assembly of claim 17 wherein said control means, in response to said chamber air pressure being below said desired chamber air pressure, actuates said air pump.

* * * * *

UNITED STATES PATENT AND TRADEMARK OFFICE

CERTIFICATE OF CORRECTION

PATENT NO. : 4,995,124

DATED : February 26, 1991

INVENTOR(S) : Wridge, Jr. et al.

It is certified that error appears in the above-identified patent and that said Letters Patent is hereby corrected as shown below:

| COLUMN | LINE | ERROR |
|---|---|---|
| Drawings: | | Sheet 2 of 2, Delete entire sheet and substitute therefor the attached sheets |

Signed and Sealed this

Ninth Day of March, 1993

*Attest:*

STEPHEN G. KUNIN

*Attesting Officer*

*Acting Commissioner of Patents and Trademarks*